US012546480B2

(12) United States Patent
Alford et al.

(10) Patent No.: US 12,546,480 B2
(45) Date of Patent: Feb. 10, 2026

(54) COOKING APPLIANCE AND METHOD FOR REDUCING DISPLAY TEMPERATURES OF A COOKING APPLIANCE

(71) Applicant: Haier US Appliance Solutions, Inc., Wilmington, DE (US)

(72) Inventors: Jennifer Alford, Louisville, KY (US); Jeremy Michael Green, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 661 days.

(21) Appl. No.: 17/745,948

(22) Filed: May 17, 2022

(65) Prior Publication Data

US 2023/0375185 A1 Nov. 23, 2023

(51) Int. Cl.
*F24C 3/12* (2006.01)
*F24C 15/00* (2006.01)

(52) U.S. Cl.
CPC ..... *F24C 15/006* (2013.01); *F24C 3/124* (2013.01)

(58) Field of Classification Search
CPC .. F24C 3/124; F24C 3/00; F24C 3/085; F24C 3/12; F24C 15/006; F24C 15/105; F24C 15/106; F24C 15/2021; F24C 7/08; F24C 7/082; F24C 7/086; G01K 1/026; F24H 15/20
USPC ..... 126/21 A, 299 D, 39 BA, 276
See application file for complete search history.

(56) References Cited

U.S. PATENT DOCUMENTS

| | | | | |
|---|---|---|---|---|
| 10,948,193 | B2 | 3/2021 | Phillips et al. | |
| 11,125,442 | B2 | 9/2021 | Hanna et al. | |
| 2012/0208138 | A1* | 8/2012 | Wortman | F24H 15/429 126/92 AC |
| 2013/0312731 | A1* | 11/2013 | Zehr | F24C 15/006 454/256 |
| 2018/0245797 | A1* | 8/2018 | Johnson | F24C 15/006 |
| 2020/0092958 | A1* | 3/2020 | Neal | F24C 15/006 |
| 2020/0408412 | A1* | 12/2020 | Hanna | F24C 15/006 |
| 2021/0048860 | A1* | 2/2021 | Jinta | G02F 1/1368 |

(Continued)

FOREIGN PATENT DOCUMENTS

| | | | | |
|---|---|---|---|---|
| EP | 2133735 | B1 | 10/2012 | |
| GB | 2349457 | A * | 11/2000 | F24C 15/006 |
| JP | 2003014239 | A | 1/2003 | |

(Continued)

OTHER PUBLICATIONS

JP2009074729A translation (Year: 2009).*
JP-20211181869 translation (Year: 2021).*

*Primary Examiner* — Edelmira Bosques
(74) *Attorney, Agent, or Firm* — Dority & Manning, P.A.

(57) ABSTRACT

A cooking appliance includes a cooktop having a first burner and a second burner, a control knob assembly having a first control knob to control the first burner and a second control knob to control the second burner, a display assembly provided within the cooktop proximate the first burner, an air handler attached to the cooktop proximate the second burner, the air handler being in fluid communication with the display assembly, and a controller operably connected with the cooktop, the control knob assembly, the display assembly, and the air handler, the controller being configured to selectively operate the air handler based on an operational state of the first control knob.

16 Claims, 6 Drawing Sheets

(56) References Cited

U.S. PATENT DOCUMENTS

| | | | | |
|---|---|---|---|---|
| 2021/0398485 | A1* | 12/2021 | Park | G09G 3/3233 |
| 2022/0146111 | A1* | 5/2022 | Etgen | F24C 7/082 |

FOREIGN PATENT DOCUMENTS

| | | | | |
|---|---|---|---|---|
| JP | 4120612 | B2 | | 7/2008 |
| JP | 2009074729 | A | * | 4/2009 |
| JP | 4621720 | B2 | | 1/2011 |
| JP | 5454563 | B2 | | 3/2014 |
| JP | 2021181869 | A | * | 11/2021 |

* cited by examiner

COOKING APPLIANCE AND METHOD FOR REDUCING DISPLAY TEMPERATURES OF A COOKING APPLIANCE

FIELD OF THE INVENTION

The present subject matter relates generally to cooking appliances, and more particularly to managing heat at the display panels around cooktops.

BACKGROUND OF THE INVENTION

Conventional cooktop range appliances incorporate a plurality of heating elements on a top surface (cooktop) thereof to heat or cook food within cooking utensils. These appliances can incorporate either gas powered or electric powered cooktops (heating elements or burners), or a combination of gas and electric burners, as well as induction cooktops. Some cooking appliances have a display attached thereto to provide information to a user, such as burner temperature, heat output, cooking time, instructions, or the like. The display may be located relatively close to one or more heating elements of the cooktop. Accordingly, a relatively large amount of heat may be inadvertently supplied to the display, causing irreparable damage or malfunction.

Some oven appliances incorporate a fan (such as a cooling fan) to supply a flow of cooling air to the display in order to reduce temperatures of the display. However, these appliances have certain drawbacks. For instance, many cooling fans operate at high speeds, generating unwanted noise at inopportune times. Additionally, such fans are typically operated when the cooling of the display is unnecessary, resulting in wasted energy and undue noise.

Accordingly, a cooking or oven appliance that obviates one or more of the above-mentioned drawbacks would be beneficial. Particularly, an oven appliance that more efficiently or effectively provides cooling to a display (e.g., at an effective moment) would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance may include a cooktop including a first burner and a second burner, a control knob assembly including a first control knob to control the first burner and a second control knob to control the second burner, a display assembly provided within the cooktop proximate the first burner, an air handler attached to the cooktop proximate the second burner, the air handler being in fluid communication with the display assembly, and a controller operably connected with the cooktop, the control knob assembly, the display assembly, and the air handler. The controller may selectively operate the air handler based on an operational state of the first control knob.

In another exemplary aspect of the present disclosure, a method of operating an oven appliance is provided. The method may include determining that an operational state of the first control knob is "on," the first control knob controlling an operation of a front burner of the burner assembly; and directing an activation of the air handler to supply air across the display, the air handler being directed at a first speed in response to determining that the operational state of the first control knob is "on." A flow of the air from the air handler may be provided underneath the burner assembly along the vertical direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
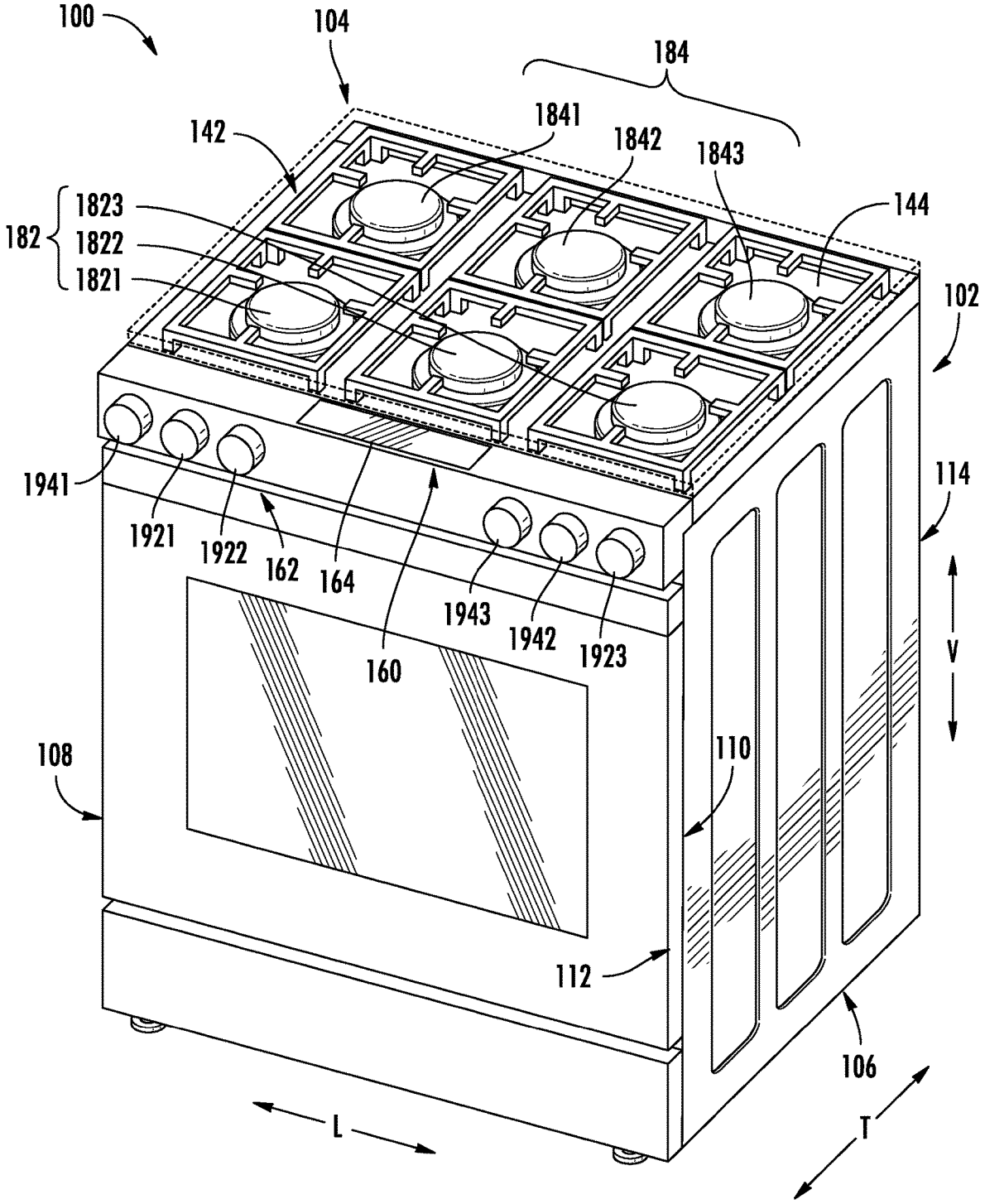
FIG. 1 provides a perspective view of a cooking appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a cooking appliance 100 as may be employed with the present subject matter. Cooking appliance 100 generally defines a vertical direction V, a lateral direction L, and a transverse direction T, each of which is mutually perpendicular, such that an orthogonal coordinate system is generally defined. As illustrated, cooking appliance 100 includes an insulated cabinet 102. Cabinet 102 of cooking appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Within cabinet 102 is a single cooking chamber 120 which is configured for the receipt of one or more food items to be cooked. However, it should be appreciated that cooking appliance 100 is provided by way of example only, and aspects of the present subject matter may be used in any suitable cooking appliance, such as a stand-alone cooktop appliance. Thus, the example embodiment shown in FIG. 1 is not intended to limit the present subject matter to any particular cooking chamber configuration or arrangement. Indeed, aspects of the present subject matter may be applied to door assemblies or display assemblies for any suitable appliance.

Cooking appliance 100 includes a door 124 rotatably attached to cabinet 102 in order to permit selective access to cooking chamber 120. Handle 126 is mounted to door 124 to assist a user with opening and closing door 124 in order to access cooking chamber 120. As an example, a user can pull on handle 126 mounted to door 124 to open or close door 124 and access cooking chamber 120. One or more transparent viewing windows 128 (FIG. 1) may be defined within door 124 to provide for viewing the contents of cooking chamber 120 when door 124 is closed and also assist with insulating cooking chamber 120.

Figure 2:
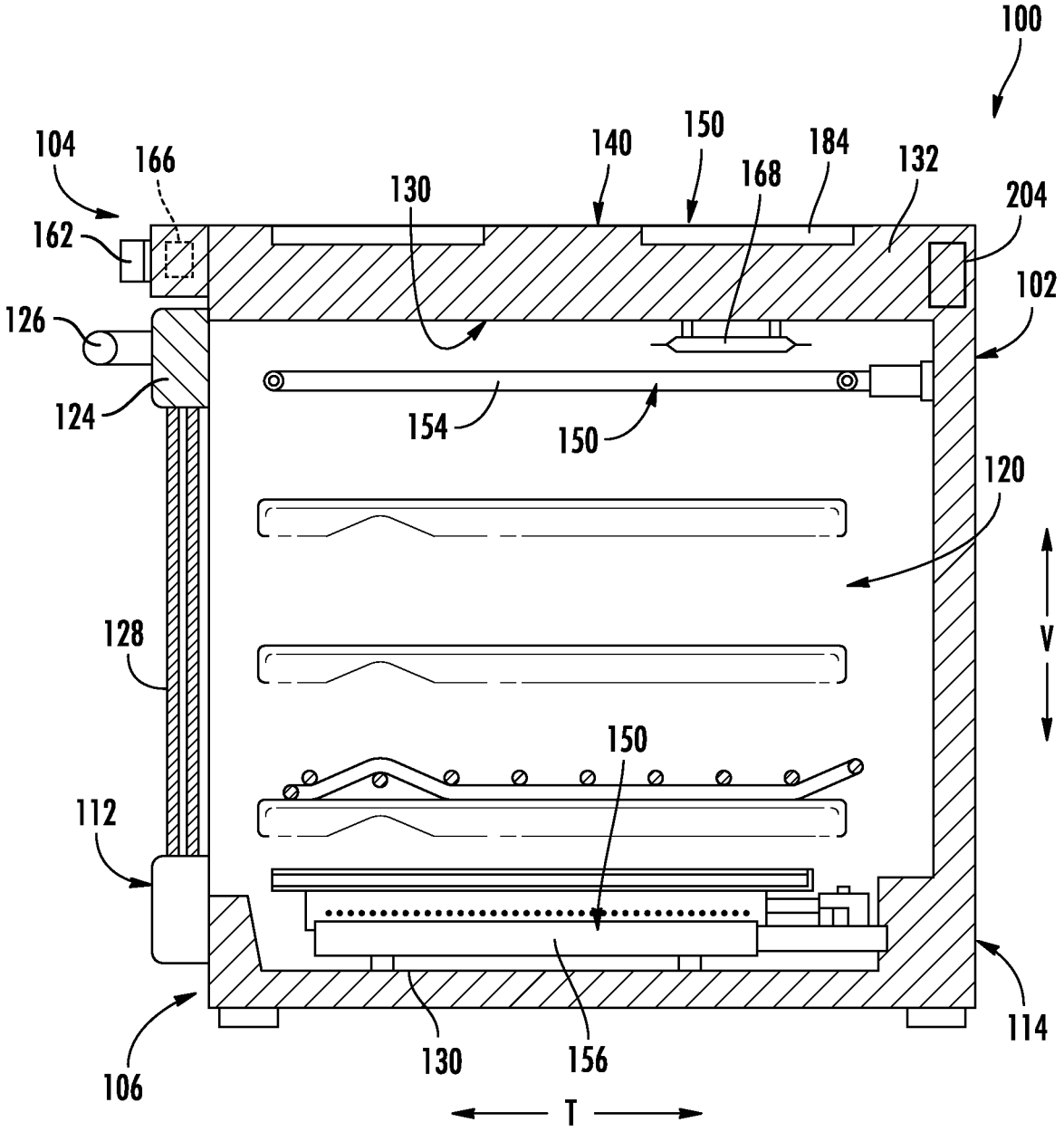
FIG. 2 provides a side section view of the exemplary cooking appliance of FIG. 1.

In general, cooking chamber 120 is defined by a plurality of chamber walls 130 (FIG. 2). Specifically, cooking chamber 120 may be defined by a top wall, a rear wall, a bottom wall, and two sidewalls 130. These chamber walls 130 may be joined together to define an opening through which a user may selectively access cooking chamber 120 by opening door 124. In order to insulate cooking chamber 120, cooking appliance 100 includes an insulating gap defined between the chamber walls 130 and cabinet 102. According to an exemplary embodiment, the insulation gap is filled with an insulating material 132, such as insulating foam or fiberglass, for insulating cooking chamber 120.

Cooking appliance 100 also includes a cooktop 140. Cooktop 140 is positioned at or adjacent top 104 of cabinet 102 such that it is positioned above cooking chamber 120. Specifically, cooktop 140 includes a top panel 142 positioned proximate top 104 of cabinet 102. By way of example, top panel 142 may be constructed of glass, ceramics, enameled steel, and combinations thereof. One or more grates 144 are supported on a top surface of top panel 142 for supporting cooking utensils, such as pots or pans, during a cooking process.

Cooking appliance 100 may further include one or more heating elements (identified generally by reference numeral 150) for selectively heating cooking utensils positioned on grates 144 or food items positioned within cooking chamber 120. For example, referring to FIG. 1, heating elements 150 may be gas burners 150. Specifically, a plurality of gas burners 150 are mounted within or on top of top panel 142 such that grates 144 support cooking utensils over gas burners 150 while gas burners 150 provide thermal energy to cooking utensils positioned thereon, e.g., to heat food and/or cooking liquids (e.g., oil, water, etc.). Gas burners 150 can be configured in various sizes so as to provide e.g., for the receipt of cooking utensils (i.e., pots, pans, etc.) of various sizes and configurations and to provide different heat inputs for such cooking utensils. According to alternative embodiments, cooking appliance 100 may have other cooktop configurations or burner elements.

In addition, heating elements 150 may be positioned within or may otherwise be in thermal communication with cooking chamber 120 for regulating the temperature within cooking chamber 120. Specifically, an upper gas heating element 154 (also referred to as a broil heating element or gas burner) may be positioned in cabinet 102, e.g., at a top portion of cooking chamber 120, and a lower gas heating element 156 (also referred to as a bake heating element or gas burner) may be positioned at a bottom portion of cooking chamber 120. Upper gas heating element 154 and lower gas heating element 156 may be used independently or simultaneously to heat cooking chamber 120, perform a baking or broil operation, perform a cleaning cycle, etc. The size and heat output of gas heating elements 154, 156 can be selected based on the, e.g., the size of cooking appliance 100 or the desired heat output. Cooking appliance 100 may include any other suitable number, type, and configuration of heating elements 150 within cabinet 102 and/or on cooktop 140. For example, cooking appliance 100 may further include electric heating elements, induction heating elements, or any other suitable heat generating device.

A user interface panel 160 is located within convenient reach of a user of the cooking appliance 100. For this example embodiment, user interface panel 160 includes knobs 162 that are each associated with one of heating elements 150. In this manner, knobs 162 allow the user to activate each heating element 150 and determine the amount of heat input provided by each heating element 150 to cooking food items within cooking chamber 120 or on cooktop 140. Although shown with knobs 162, it should be understood that knobs 162 and the configuration of cooking appliance 100 shown in FIG. 1 is provided by way of example only. More specifically, user interface panel 160 may include various input components, such as one or more of a variety of touch-type controls, electrical, mechanical or electro-mechanical input devices including rotary dials, push buttons, and touch pads. User interface panel 160 may also be provided with one or more graphical display devices or display components 164, such as a digital or analog display device designed to provide operational feedback or other information to the user such as e.g., whether a particular heating element 150 is activated and/or the rate at which the heating element 150 is set.

Generally, cooking appliance 100 may include a controller 166 in operative communication with user interface panel 160. User interface panel 160 of cooking appliance 100 may be in communication with controller 166 via, for example, one or more signal lines or shared communication busses, and signals generated in controller 166 operate cooking appliance 100 in response to user input via user input devices 162. Input/Output ("I/O") signals may be routed between controller 166 and various operational components of cooking appliance 100 such that operation of cooking appliance 100 can be regulated by controller 166. In addition, controller 166 may also be in communication with one or more sensors, such as temperature sensor 168 (FIG. 2), which may be used to measure temperature inside cooking chamber 120 and provide such measurements to the controller 166. Although temperature sensor 168 is illustrated at a top and rear of cooking chamber 120, it should be appreciated that other sensor types, positions, and configurations may be used according to alternative embodiments.

Controller 166 is a "processing device" or "controller" and may be embodied as described herein. Controller 166 may include a memory and one or more microprocessors, microcontrollers, application-specific integrated circuits (ASICS), CPUs or the like, such as general or special purpose microprocessors operable to execute programming instructions or micro-control code associated with operation of cooking appliance 100, and controller 166 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

As mentioned above, cooktop 140 may include a plurality of heating elements (or burners) 150. In detail, the plurality of burners 150 may include a first burner 182 and a second burner 184. First burner 182 may be provided at or near front 112 of cabinet 102 (or a front of cooktop 140). Thus, second burner 184 may be provided at or near rear 114 of cabinet 102 (or a rear of cooktop 140). Additionally or alternatively, first burner 182 may include a plurality of front burners, such as a first front burner 1821, a second front burner 1822, and a third front burner 1823 (as shown in FIG. 1). Likewise, second burner 184 may include a plurality of rear burners, such as a first rear burner 1841, a second rear burner 1842, and a third rear burner 1843. It should be understood that any number of first burners 182 and second burners 184 may be provided and the disclosure is not limited to the examples given herein. Additionally or alternatively, first burners 182 and second burners 184 may be any suitable style of burner or heating element, such as gas burners, conduction elements, induction elements, griddles, or the like.

Cooktop 140 (or cooking appliance 100) may include a plurality of knobs (or control knobs) 162. The plurality of knobs 162 may respectively be linked to or control the plurality of burners 150 (e.g., with or through controller 166). For example, the plurality of knobs 162 includes a first control knob 192 to control first burner 182 and a second control knob 194 to control second burner 184. Similar to the burners, first control knob 192 may include a plurality of front control knobs, such as a first front knob 1921, a second front knob 1922, and a third front knob 1923. First front knob 1921 may control first front burner 1821, second front knob 1922 may control second front burner 1822, and third front knob 1923 may control third front burner 1823. Similarly, second control knob 194 may include a plurality of rear control knobs, such as a first rear knob 1941, a second rear knob 1942, and a third rear knob 1943. First rear knob 1941 may control first rear burner 1841, second rear knob 1942 may control second rear burner 1842, and third rear knob 1943 may control third rear burner 1843.

Cooking appliance 100 may include a cooling system 200. As shown, cooling system 200 may include a cooling duct (or air duct) 202 that generally extends between (and provides fluid communication between) user interface panel 160 and an ambient atmosphere outside of cooking appliance 100 (e.g., at rear 114 of cabinet 102). Cooking appliance 100 may further include an air handler 204 that is attached to or in fluid communication with cooling duct 202. During use, air handler 204 may facilitate a cooling or air supply process of user interface panel 160 (e.g., display 164). For example, air handler 204 selectively urges a flow of air through cooling duct 202 to display 164. According to the illustrated exemplary embodiment, air handler 204 is an axial fan positioned within cooling duct 202. However, it should be appreciated that according to alternative embodiments, air handler 204 may be positioned at any other suitable location and may be any other suitable fan type, such as a tangential fan, a centrifugal fan, etc. Air handler 204 may be operably connected with controller 166. For instance, air handler 204 may be selectively operated according to an input received from controller 166 according to air requirements, as will be explained below.

In addition, according to an exemplary embodiment, air handler 204 is a variable speed fan such that it may rotate at different rotational speeds, thereby generating different air flow rates. In this manner, the amount of air supplied to user interface panel 160 may be continuously and precisely regulated. Moreover, by pulsing the operation of air handler 204 or throttling air handler 204 between different rotational speeds (e.g., predetermined rotational speeds), the flow of air supplied to user interface panel 160 may have a different flow velocity or may generate a different flow pattern within cooling duct 202. Thus, by pulsating the variable speed fan or otherwise varying the rotational speed of air handler 204, the flow of air may be randomized, advantageously eliminating stagnant regions within cooling duct 202 and ensuring an even or dispersed cooling profile.

Figure 3:
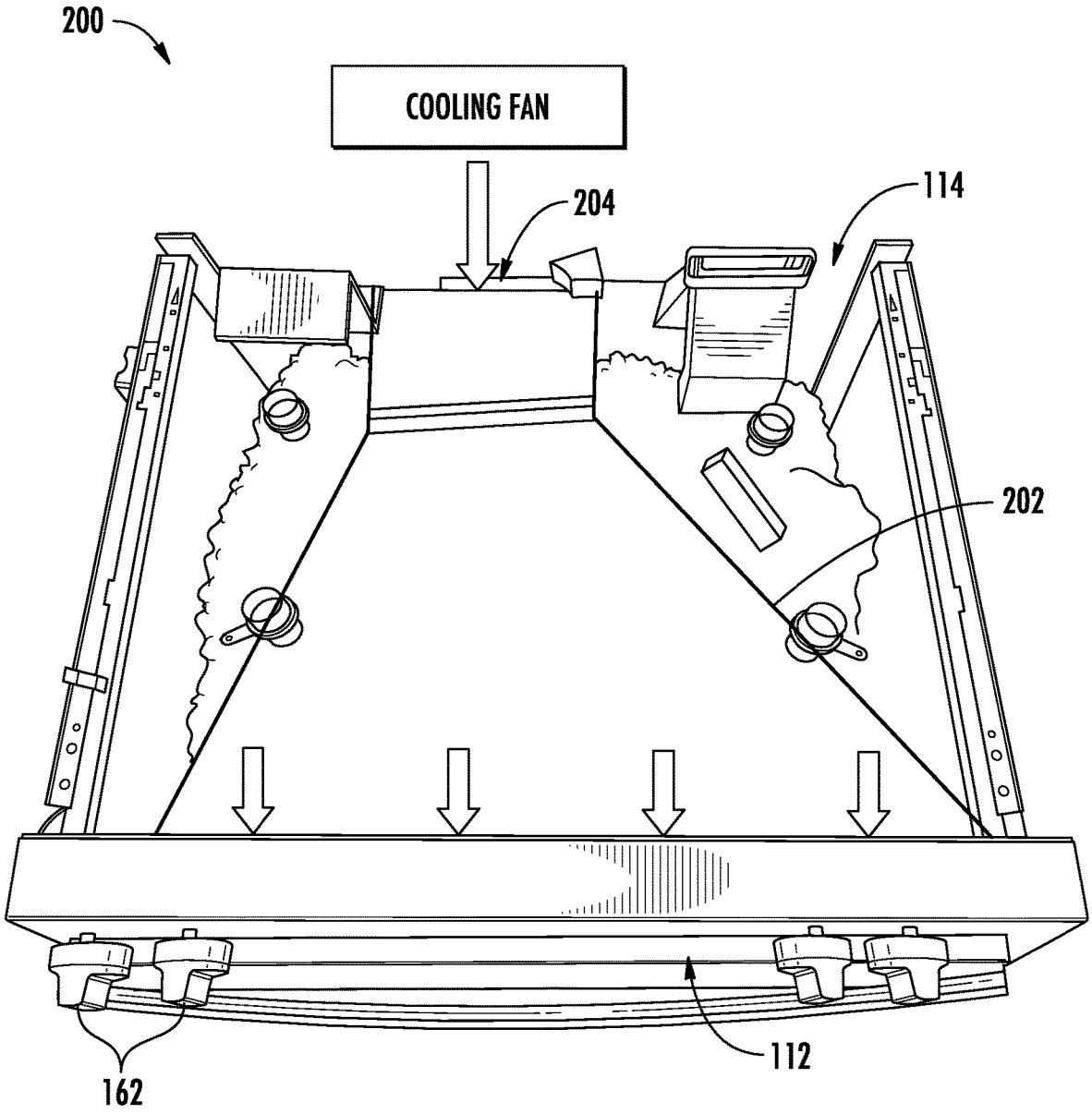
FIG. 3 provides a top view of the exemplary cooking appliance of FIG. 1 with a cooktop removed.

As shown in FIGS. 2 and 3, air handler 204 may be provided proximate second burner 184. In detail, air handler 204 may be located at or near rear 114 of cabinet 102 (e.g., closer to rear 114 than to front 112 relative to the transverse direction T). Notably, air handler 204 may be provided distal to front 112 of cabinet 102, away from the typical position of a user, thereby reducing an effect of an operating noise of air handler 204. Further, air handler 204 may be positioned at or near a lateral center of cabinet 102. For instance, air handler 204 may be positioned within 20% in either lateral direction L of a center point of rear 114 of cabinet 102. Additionally or alternatively, cooling duct 202 may be positioned beneath cooktop 140 (e.g., along the vertical direction V). Accordingly, air (cooling air) may be supplied from rear 114 of cabinet 102 along the transverse direction T towards front 112 of cabinet 102 (e.g., such that the lateral width of duct 202 is larger proximal to front 112 than the lateral width of duct 202 proximal to rear 114). Moreover, cooling duct 202 may expand along the lateral direction L towards front 112 of cabinet 102. Thus, the cooling air may be efficiently supplied to an entirety of user interface panel 160.

Figure 4:
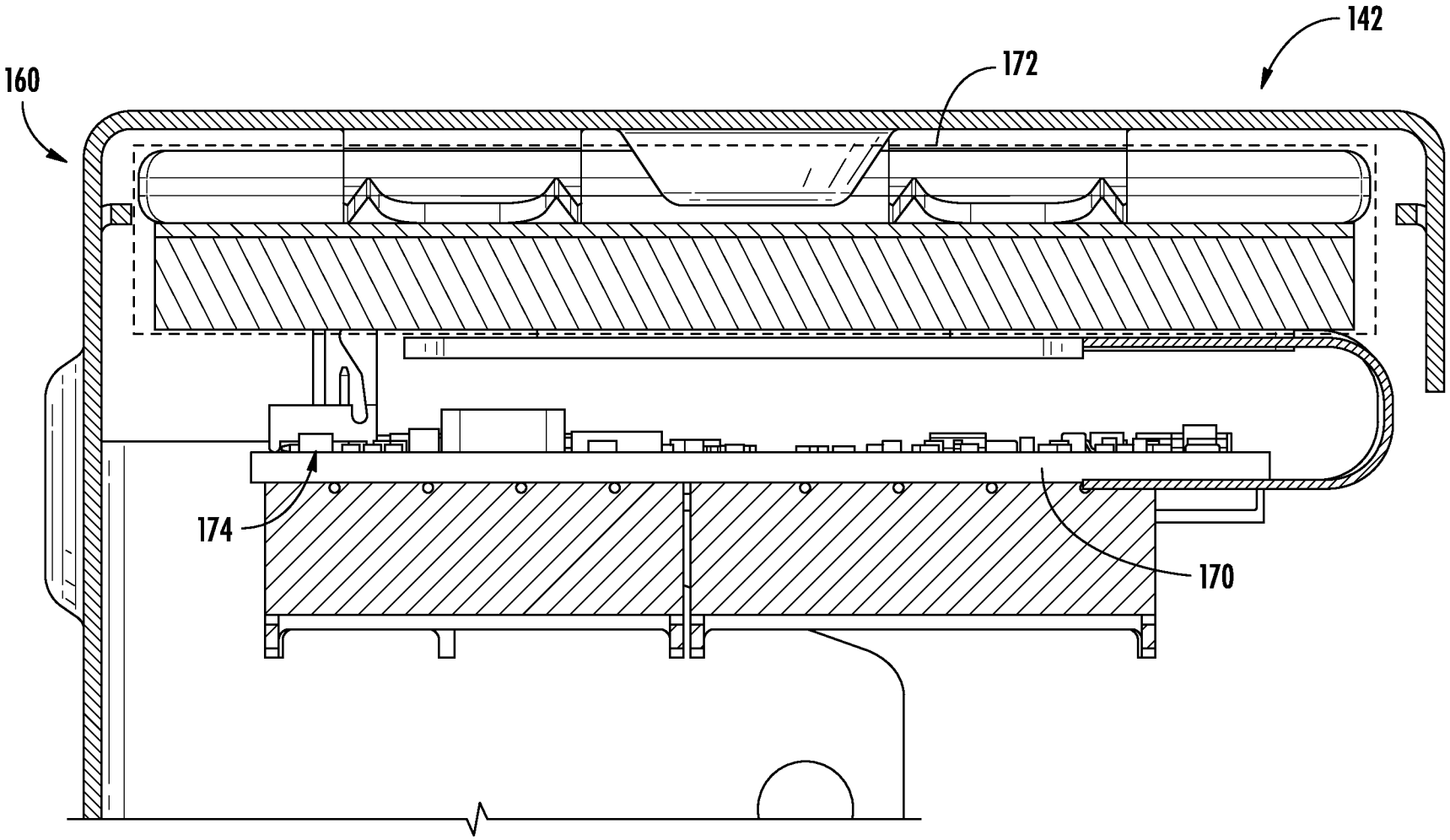
FIG. 4 provides a side section view of a display assembly of the exemplary cooking appliance of FIG. 1.

With reference to FIG. 4 and as described briefly above, user interface panel 160 may include display (or display assembly) 164. Display assembly 164 may include a display control board 170 and a display panel 172 operably connected to display control board 170. For instance, display control board 170 may be provided as or otherwise include a printed circuit board (PCB) operably connected to controller 166. Accordingly, display control board 170 may send and receive communications to and from controller 166 regarding inputs to display panel 172 (e.g., a touch display) or information to be output on display panel 172. Display panel 172 may be a liquid crystal display (LCD) panel. Additionally or alternatively, as seen in FIG. 1, display panel 172 may be vertically flush with cooktop 140. In detail, display panel 172 may be disposed along a plane defined along the lateral direction L and transverse direction T that is coplanar with top panel 142. In some embodiments, top panel 142 is defined as a base for heating elements 150 (e.g., gas burning heating elements). For instance, top panel 142 may form a basin comprising a plurality of apertures into which one or more gas burning heating elements 150 are positioned. Thus, in some embodiments, top panel 142 is recessed along the vertical direction V into cabinet 102. However, top panel 142 may refer to a glass panel covering one or more of heating elements 150 (e.g., to receive one or more cooking utensils on the glass panel).

Cooking appliance 100 may include a temperature sensor 174. Temperature sensor 174 may be provided within cooktop 140. For instance, temperature sensor 174 may be in thermal communication with display assembly 164. In detail, temperature sensor 174 may be in conductive or convective thermal communication with display assembly 164. As such, temperature sensor 174 may sense, measure, or otherwise determine a temperature of air surrounding display assembly 164 (e.g., display panel 172), or a direct temperature of display assembly 164 (e.g., via conductive thermal communication). According to at least one embodiment, temperature sensor 174 is a thermistor attached to display control board 170. When assembled, temperature sensor 174 may monitor a temperature of display assembly 164 throughout an operation of oven appliance 100 (e.g., cooktop 140). In detail, temperature sensor 174 may monitor a temperature of display panel 172 during an operation of cooktop 140. In other words, temperature sensor 174 may detect or measure (e.g., repeatedly) the temperature of display panel 172 and transmit such detections (e.g., as an electric or data signal to controller 166).

As used herein, "temperature sensor" or the equivalent is intended to refer to any suitable type of temperature measuring system or device positioned at any suitable location for measuring the desired temperature. Thus, for example, temperature sensor 174 may be any suitable type of temperature sensor, such as a thermistor, a thermocouple, a resistance temperature detector, a semiconductor-based integrated circuit temperature sensors, etc. In addition, temperature sensor 174 may be positioned at any suitable location and may output a signal, such as a voltage, to a controller that is proportional to and/or indicative of the temperature being measured. Although exemplary positioning of temperature sensors is described herein, it should be appreciated that appliance 100 may include any other suitable number, type, and position of temperature and/or other sensors according to alternative embodiments.

Figure 5:
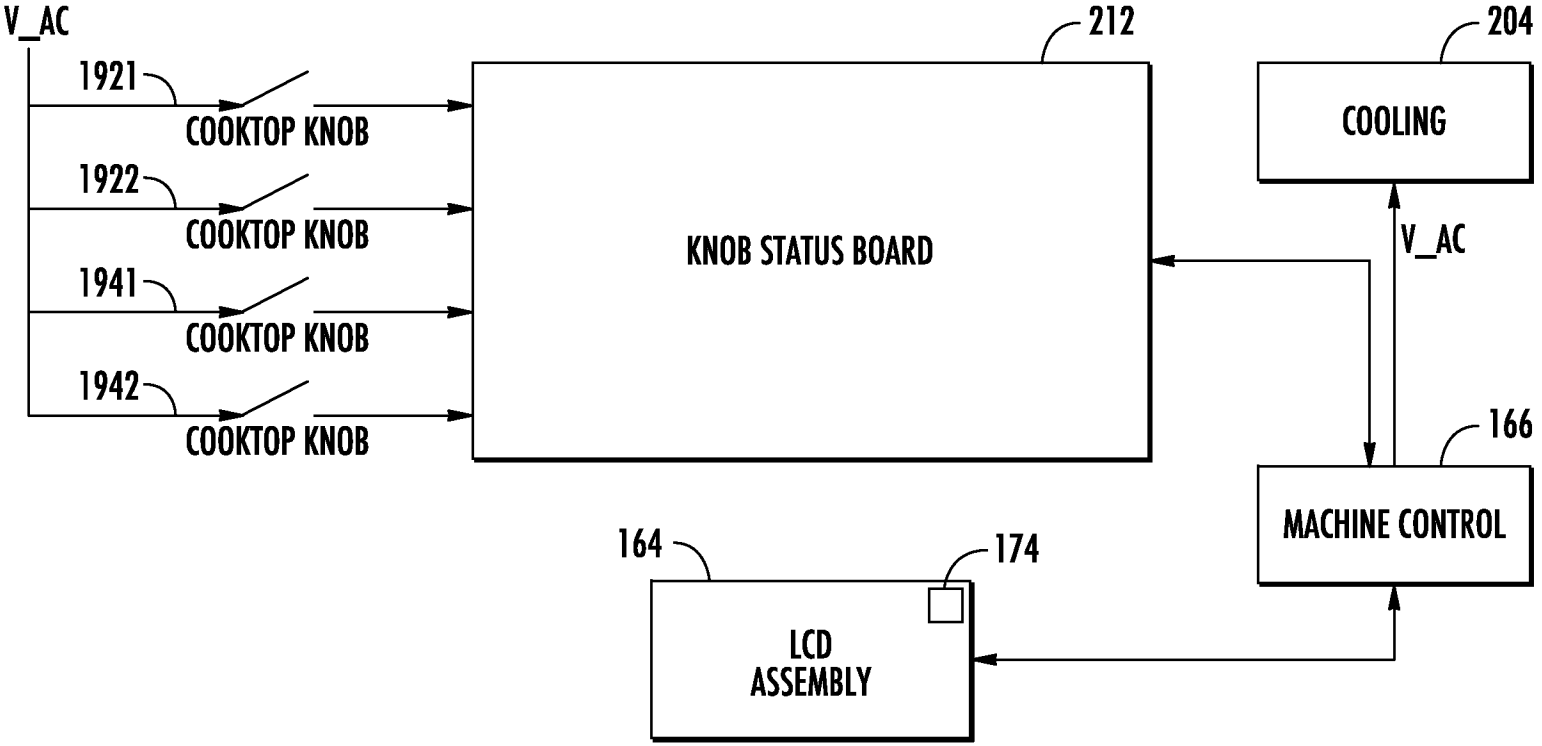
FIG. 5 provides a schematic view of a control system of the exemplary cooking appliance of FIG. 1.

FIG. 5 provides a schematic representation of an exemplary control system 210 of oven appliance 100. Control system 210 may be operated or controlled by, for example, controller 166. Control system 210 may facilitate communication between knobs 162, air handler 204, display assembly 164, controller 166, and the like. For instance, control system 210 may include a knob status control board 212. According to some embodiments, knob status control board 212 is incorporated into controller 166. However, knob status control board 212 may be a stand-alone control board provided within oven appliance 100 and operably connected with controller 166. Knob status control board 212 may monitor an operational status of each knob 162 (e.g., first control knob(s) 192 and second control knob(s) 194). For instance, each of first front knob 1921, second front knob 1922, and third front knob 1923 may have a dedicated input (e.g., electrical input) to knob status control board 212. Similarly, each of first rear knob 1941, second rear knob 1942, and third rear knob 1943 may have a dedicated input to knob status control board 212.

The operational status of each knob 162 may include an "on" state and an "off" state. In detail, knob status control board 212 may determine whether an individual control knob (e.g., first front knob 1921, second front knob 1922, etc.) is turned, manipulated, operated, or the like into the "on" state. For purposes of this disclosure, the "on" state may refer to any knob position which provides a signal (e.g., to controller 166) to activate a respective burner 150 (e.g., first front burner 1821, second front burner 1822, etc.). The activation of the burner 150 may be at any suitable level (e.g., power level). For an example, knob status control board 212 is able to determine that first front control knob 1921 has been manipulated to a position requiring a power output to first front burner 1821. The power output may be 100%, 75%, 50%, 25%, or any appreciable power level. Conversely, control knob 162 may be in the "off" position when no signal is present to provide power to a respective burner 150. Notably, knob status control board 212 can determine an individual activation status (or operational status) for each control knob 162. Thus, knob status control board 212 may determine that first front control knob 1921 is activated to the "on" state while first rear control knob 1941 remains in the "off" position.

Figure 6:
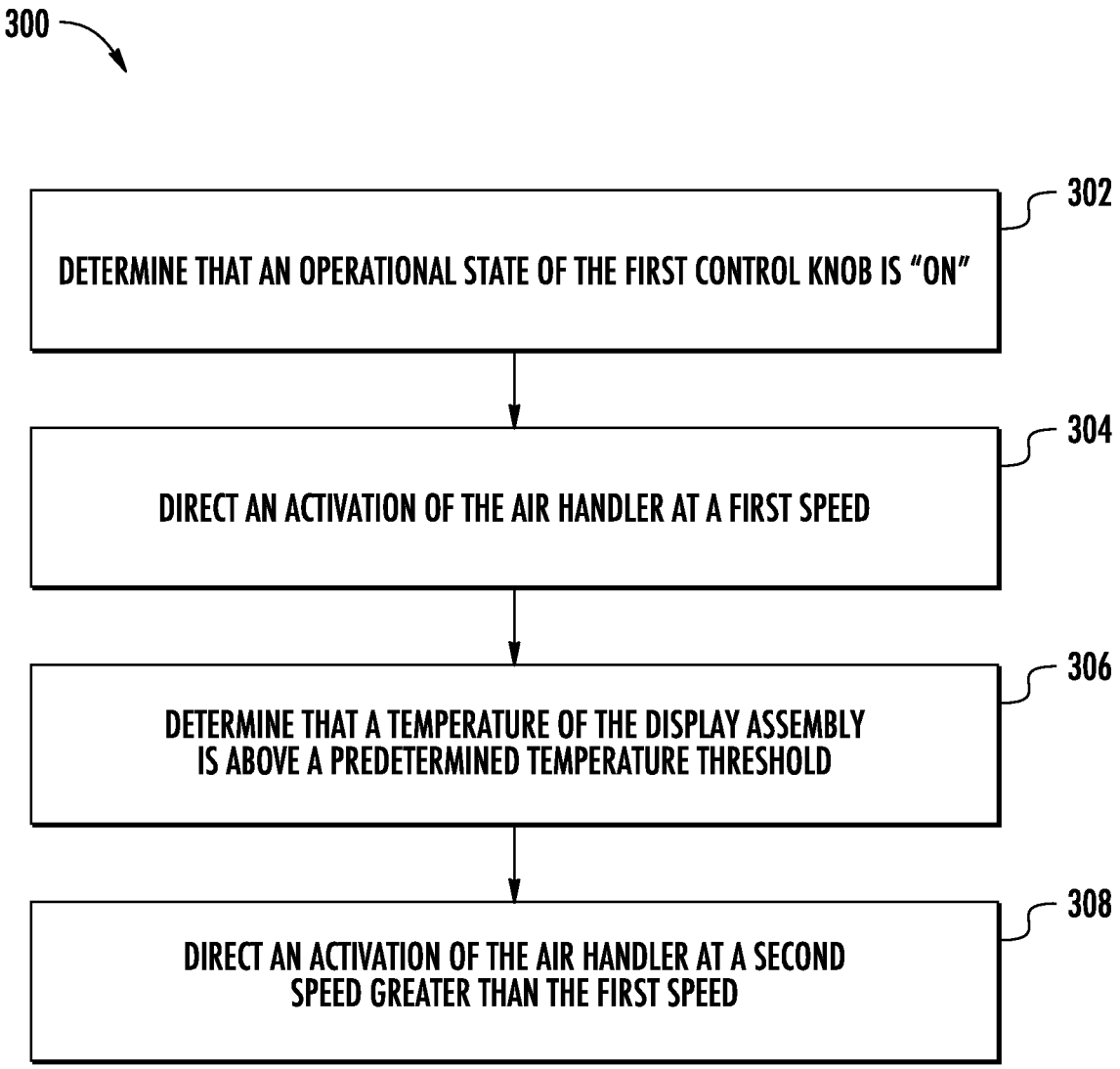
FIG. 6 provides a flow chart illustrating a method of operating a cooking appliance.

Now that the general descriptions of an exemplary oven appliance have been described in detail, a method 300 of operating an appliance (e.g., oven appliance 100) will be described in detail. Although the discussion below refers to the exemplary method 300 of operating oven appliance 100, one skilled in the art will appreciate that the exemplary method 300 is applicable to any suitable domestic appliance capable of performing a cooking operation (e.g., such as a stand-alone cooktop, an oven appliance, etc.). In exemplary embodiments, the various method steps as disclosed herein may be performed by controller 166 and/or a separate, dedicated controller. FIG. 6 provides a flow chart illustrating a method of operating a cooking appliance. Hereinafter, method 300 will be described with specific reference to FIG. 6.

At step 302, method 300 may include determining that an operational state of the first control knob is "on". For example, the first control knob (e.g., first front knob 1921) may be configured to control a front burner (e.g., first front burner 1821). As mentioned above, each individual control knob may be operably (e.g., electronically) connected with a knob status control board (e.g., knob status control board 212) or directly with a controller. Thus, the knob status control board may determine that a specific control knob of the plurality of control knobs is activated to an "on" state. The knob status control board may utilize a switch to determine the operational status of each control knob, with each control knob having a unique dedicated switch. Accordingly, the knob status control board (or controller) may determine that a first switch associated with the first control knob is activated, thereby denoting the "on" status.

At step 304, method 300 may include directing an activation of an air handler to supply air towards a display. In detail, in response to determining that a control knob is activated to the "on" status, the controller may send an activation signal to an air handler (e.g., air handler 204). The air handler may be initiated at a first speed (e.g., rotational velocity of the air handler). As mentioned above, the air handler may be a variable speed air handler capable of operating at multiple speeds to provide different levels of airflow. The first speed may be a low speed, for example. Thus, the air handler may be initiated at the first (low) speed to supply cooling air towards the display assembly (e.g., display assembly 164).

The controller (or knob status control board) may discern which knob among the plurality of control knobs has been activated. For instance, the controller may determine that one of the first control knobs (e.g., first front control knob 1921, second front control knob 1922, third front control knob 1923) is activated to the "on" state. According to some embodiments, the first control knobs control the first heating elements (burners) which are located towards a front of the cooking appliance and therefore immediately adjacent to the display assembly. Thus, the display assembly may experience elevated temperatures from the activated burners. Accordingly, when (e.g., in response to) one of the first (front) control knobs is activated to the "on" state, the controller activates the air handler to the first speed to immediately supply cooling air to the display assembly. Advantageously, temperatures of the display assembly may be maintained below a maximum operating temperature (e.g., at or below 70° C.).

At step 306, method 300 may include determining that a temperature of the display is above a predetermine temperature threshold. In detail, the controller may receive inputs from a temperature sensor (e.g., temperature sensor 174) that monitors a temperature of the display assembly. When multiple burners (e.g., multiple front burners) are activated, the display assembly may experience further elevated temperatures despite the air handler being activated at the first speed. Accordingly, the controller may receive an input that the temperature of the display assembly is above the temperature threshold (e.g., approaching the maximum operating temperature).

At step 308, method 300 may include directing the activation of the air handler at a second speed greater than the first speed. In response to determining that the temperature of the display assembly is approaching the maximum operating temperature, the controller may increase the speed of the air handler. For instance, the controller may direct the air handler at the second speed, which may be a moderate speed greater than the low speed. In some embodiments, the controller activated the air handler to a third speed (or maximum speed) in order to produce a high cooling air flow. Additionally or alternatively, the air handler may be pulsated (i.e., rapidly or semi-rapidly alternated between two or more speeds). For instance, according to one or more inputs of the temperature sensor together with the operational status of one or more control knobs, the controller may direct the air handler to operate according to a pulsating action. The pulsating action may provide alternating or staggered air currents to effectively and efficiently remove heat from around the display assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance defining a vertical direction, a lateral direction, and a transverse direction, the cooking appliance comprising: a cooktop comprising a first burner and a second burner; a control knob assembly comprising a first control knob to control the first burner and a second control knob to control the second burner; a display assembly provided within the cooktop proximate the first burner; an air handler attached to the cooktop proximate the second burner, the air handler being in fluid communication with the display assembly; an air duct provided below the cooktop and providing fluid communication between the air handler and the display assembly, wherein the airduct directs cooling air from the air handler directly to a rear surface of the display assembly; a controller operably connected with the cooktop, the control knob assembly, the display assembly, and the air handler, the controller being configured to selectively operate the air handler based on an operational state of the first control knob and a temperature of the display assembly; the air handler being directed at a first speed only in response to determining that the operational state of the first control knob is "on" and a temperature sensor provided within the cooktop and separate from but in thermal communication with the display assembly, the temperature sensor being configured to monitor the temperature of the display assembly.

2. The cooking appliance of claim 1, wherein the display assembly comprises:

a display control board and a display panel connected to the display control board, wherein the display panel is flush with the cooktop.

3. The cooking appliance of claim 1, wherein the controller is further configured to selectively operate a speed of the air handler based on the monitored temperature of the display assembly.

4. The cooking appliance of claim 1, wherein the first burner comprises a front right burner and a front left burner provided at a front of the cooktop and the second burner is provided at a rear of the cooktop along the transverse direction.

5. The cooking appliance of claim 4, wherein the first control knob comprises a front right control knob to control the front right burner and a front left control knob to control the front left burner.

6. The cooking appliance of claim 5, wherein the controller comprises a knob status control board operably connected with the front right control knob, the front left control knob, and the second control knob.

7. The cooking appliance of claim 6, wherein the knob status control board determines the operational state of each of the front right control knob and the front left control knob between an "on" state and an "off" state.

8. The cooking appliance of claim 7, wherein the controller is configured to direct a cooling operation, the cooling operation comprising:

determining that at least one of the front right control knob or the front left control knob is in the "on" state; and activating the air handler at a first speed in response to determining that at least one of the front right control knob or the front left control knob is in the "on" state.

9. The cooking appliance of claim 8, wherein the cooling operation further comprises:

determining, via the temperature sensor, that the temperature of the display assembly is above a predetermined temperature threshold; and activating the air handler at a second speed greater than the first speed in response to determining that the temperature of the display is above the predetermined temperature threshold.

10. The cooking appliance of claim 2, wherein the temperature sensor is mounted on the display control board.

11. The cooking appliance of claim 1, wherein the air handler is a multi-speed fan.

12. A method of operating an oven appliance, the oven appliance comprising a burner assembly, a control knob assembly comprising a first and a second control knob to control the burner assembly, a display assembly comprising a display control board and a display panel connected to the display control board, wherein the display panel is flush with a cooktop of the oven appliance, an air handler, and a temperature sensor in thermal communication with the display assembly to monitor a temperature of the display assembly, wherein the temperature sensor is mounted on the display control board, the method comprising:

determining that an operational state of the first control knob is "on," the first control knob controlling an operation of a front burner of the burner assembly;

directing an activation of the air handler to supply air across the display assembly, the air handler being directed at a first speed only in response to determining that the operational state of the first control knob is "on," wherein a flow of the air from the air handler is provided underneath the burner assembly along the vertical direction through an air duct provided below the cooktop and providing fluid communication between the air handler and the display assembly, wherein the airduct directs cooling air from the air handler directly to a rear surface of the display assembly;

determining that a temperature of the display assembly is above a predetermined temperature threshold; and directing the activation of the air handler at a second speed greater than the first speed only in response to determining that the temperature of the display assembly is above the predetermined temperature threshold, wherein the temperature sensor is provided within the cooktop of the oven appliance and separate from but in thermal communication with the display.

13. The method of claim 12, wherein the burner assembly comprises a first burner provided at a front of the oven appliance and a second burner provided at a rear of the oven appliance along the transverse direction, the first burner comprising a front right burner and a front left burner.

14. The method of claim 13, wherein the first control knob comprises a front right control knob to control the front right burner and a front left control knob to control the front left burner.

15. The method of claim 14, wherein the controller comprises a knob status control board operably connected with the front right control knob, the front left control knob, and the second control knob.

16. The method of claim 12, wherein the air handler is a multi-speed fan.

* * * * *